US008494380B2

(12) United States Patent
Carot

(10) Patent No.: US 8,494,380 B2
(45) Date of Patent: Jul. 23, 2013

(54) DEVELOPER STORAGE UNIT AND METHOD FOR MANUFACTURING RECYCLING PRODUCT

(75) Inventor: Juan Torres Carot, Wales (GB)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 290 days.

(21) Appl. No.: 13/072,364

(22) Filed: Mar. 25, 2011

(65) Prior Publication Data

US 2012/0243882 A1 Sep. 27, 2012

(51) Int. Cl.
*G03G 15/00* (2006.01)
*G03G 15/08* (2006.01)

(52) U.S. Cl.
USPC ..... 399/12; 399/254; 399/262

(58) Field of Classification Search
USPC ..... 399/12, 254, 262; 29/428, 407.01
See application file for complete search history.

(56) References Cited

U.S. PATENT DOCUMENTS

| | | | | |
|---|---|---|---|---|
| 8,009,996 | B2 * | 8/2011 | Ishikawa | 399/12 |
| 8,090,272 | B2 * | 1/2012 | Ishikawa | 399/12 |
| 2006/0177230 | A1 * | 8/2006 | Ishii | 399/12 |
| 2006/0193644 | A1 * | 8/2006 | Takagi | 399/12 |
| 2006/0193645 | A1 * | 8/2006 | Kishi | 399/12 |
| 2006/0193646 | A1 * | 8/2006 | Suzuki et al. | 399/12 |
| 2007/0031158 | A1 * | 2/2007 | Kamimura | 399/12 |
| 2008/0193154 | A1 * | 8/2008 | Yamada | 399/53 |
| 2008/0205911 | A1 * | 8/2008 | Ishikawa et al. | 399/12 |
| 2009/0269086 | A1 * | 10/2009 | Mikuni | 399/12 |
| 2010/0054763 | A1 * | 3/2010 | Tomiyori et al. | 399/12 |
| 2013/0051814 | A1 * | 2/2013 | Itabashi et al. | 399/12 |
| 2013/0051815 | A1 * | 2/2013 | Itabashi et al. | 399/12 |
| 2013/0051833 | A1 * | 2/2013 | Itabashi et al. | 399/90 |

* cited by examiner

*Primary Examiner* — G. M. Hyder
(74) *Attorney, Agent, or Firm* — Baker Botts L.L.P.

(57) ABSTRACT

A developer storage unit includes first and second rotary members. The first rotary member includes: first contacting portion capable of contacting with the second rotary member, first non-contacting portion not in contact with the second rotary member, and first stopper portion offset from the first contacting portion in an axial direction of the first rotary member. The second rotary member includes: second contacting portion capable of contacting with the first rotary member, second non-contacting portion not in contact with the first rotary member, second stopper portion offset from the second contacting portion in an axial direction of the second rotary member, and detected portion detected by detector. The second stopper portion comes into contact with the first stopper portion when the detected portion is moved from used product detecting position to new product detecting position while the first non-contacting portion is positioned to face the second rotary member.

13 Claims, 8 Drawing Sheets

DEVELOPER STORAGE UNIT AND METHOD FOR MANUFACTURING RECYCLING PRODUCT

BACKGROUND OF THE INVENTION

1. Field of the Invention

The present invention relates to a developer storage unit including a detected portion used for determining whether the developer storage unit is a new product. The present invention is also relates to a method for manufacturing a recycling product including a process of resetting the detected portion to an initial position.

2. Description of Related Art

Generally, in an image forming apparatus such as a laser printer, toner is stored in a developing cartridge, which is detachably mounted in the main body of the image forming apparatus. In this image forming apparatus, a known technique may be used for determining whether the attached cartridge is a new product (i.e., new product detection).

To be more specific, the main body of the image forming apparatus includes a detection actuator in the form of a swingable arm, a sensor for detecting a swinging motion of the detection actuator, and a controller for performing a new product detection based on a signal from the sensor. Further, the developing cartridge attached to the image forming apparatus includes a gear mechanism for transmitting a driving force to other parts such a developing roller and an agitator, a gear cover for covering the gear mechanism, and a detection gear having a detection protrusion (i.e., detected portion) extending from inside to outside of the gear cover and configured to rotate by receiving the driving force from the gear mechanism.

According to this image forming apparatus, when a new developing cartridge is attached to the main body, the detection protrusion comes into contact with and pushes one end of the detection actuator and thereby causes the detection actuator to swing. This swinging motion of the detection actuator is detected by the sensor. The sensor detects the swinging motion and sends a detection signal to the controller. The controller receives the detection signal from the sensor, and based on the detection signal, determines that the developing cartridge is a new product.

In this image forming apparatus, for example, when a front cover is closed after the developing cartridge is attached to the main body, a warming-up operation (i.e., idle rotation operation) is initiated by the controller. The idle rotation operation is an operation of rotating the agitator within the developing cartridge to agitate toner in the cartridge.

In the idle rotation operation, a driving force is transmitted from a drive source disposed in the main body to the agitator and the detection gear through the gear mechanism. Therefore, agitation of the toner using the agitator is initiated, and the detection protrusion rotates and disengages from the detection actuator.

Accordingly, in a used developing cartridge, the detection protrusion is located in a position different from the initial position. If the used developing cartridge is detached from the main body of the image forming apparatus and attached again to the image forming apparatus, the attached developing cartridge is determined as a used product because the detection protrusion does not cause the detection actuator to swing in the image forming apparatus and the controller does not receive a detection signal.

In the field of developing cartridge using the detection protrusion as described above, for the purpose of improving the workability for recycling the developing cartridge, it is desirable that the detection protrusion can be reset from a used product detecting position to the initial position without removing the gear cover. However, if the developing cartridge is designed such that anyone can easily reset the detection protrusion and position the same to the initial position, the user may unintentionally move the detection protrusion to the initial position. In the case where the controller controls the service life (e.g., deterioration of toner, remaining amount of toner, etc.) of the cartridge based on the time point when the cartridge installed is determined as a new product, the control of the controller becomes inaccurate.

In view of the above, it is desirable to improve the workability for recycling a developing cartridge as well as to prevent the detection protrusion (detected portion) from being reset to the new product detecting position due to the user's unintentional operation.

SUMMARY OF THE INVENTION

According to a first aspect of the present invention, there is provided a developer storage unit designed to be detachably attached to an image forming apparatus, the developer storage unit comprising: a casing for storing developer; an agitating member configured to agitate developer within the casing; a force transmission mechanism configured to transmit a driving force from the image forming apparatus at least to the agitating member; and a cover attached to the casing for covering the force transmission mechanism. The force transmission mechanism comprises: a driving force input member configured to rotate when the driving force is transmitted from the image forming apparatus: a first rotary member configured to rotate by receiving the driving force from the driving force input member; and a second rotary member configured to rotate by receiving the driving force from the first rotary member. The first rotary member includes: a first contacting portion capable of contacting with the second rotary member to transmit the driving force to the second rotary member; a first non-contacting portion arranged in the same axial position as that of the first contacting portion but radially inward from the first contacting portion, so as not to contact with the second rotary member; and a first stopper portion provided in a position offset from the first contacting portion in an axial direction of the first rotary member, whereas the second rotary member includes: a second contacting portion capable of contacting with the first rotary member to receive the driving force from the first rotary member; a second non-contacting portion arranged in the same axial position as that of the second contacting portion but radially inward from the second contacting portion, so as not to contact with the first rotary member; a second stopper portion provided in a position offset from the second contacting portion in an axial direction of the second rotary member; and a detected portion extending from a position offset from a center of rotation of the second rotary member toward an outside of the cover, the detected portion being detected by a detector provided in the image forming apparatus. The detected portion is configured to be movable between a new product detecting position and a used product detecting position that is different from the new product detecting position, and the detected portion is positioned in the new product detecting position before use of the developer storage unit and in the used product detecting position after use of the developer storage unit. When the second rotary member is caused to be rotated in a direction where the detected portion moves from the used product detecting position to the new product detecting position while the first non-contacting portion of the first rotary member is positioned to face the second rotary member, the second stopper portion comes into contact with the first stopper portion before the detected portion reaches the new product detecting position.

It is to be noted that "the first non-contacting portion of the first rotary member is positioned to face the second rotary member" indicates a state in which the second contacting portion does not contact with the first contacting portion and the second rotary member is freely rotatable, and more specifically indicates a state in which the first contacting portion of the first rotary member is completely moved away from and positioned outside the rotation locus of the second contacting portion of the second rotary member.

According to a second aspect of the present invention, there is provided a method for manufacturing a recycling product by recycling a developer storage unit, which comprises two adjacent rotary members each comprising: a contacting portion capable of contacting with another adjacent rotary member to transmit a driving force between the adjacent rotary members; a non-contacting portion arranged radially inward from the contacting portion so as not to contact with the adjacent rotary member; a stopper portion provided in a position offset from the contacting portion in an axial direction of the rotary member; and a detected portion provided on one rotary member of the two adjacent rotary members and configured to be detected by a detector provided in an image forming apparatus, wherein the method comprises the following steps for resetting the detected portion from a used product detecting position to a new product detecting position: bringing the non-contacting portion of the other rotary member into a position facing to the one rotary member; causing the one rotary member to rotate from the used product detecting position to a contacting position at which the stopper portion of the one rotary member and the stopper portion of the other rotary member are in contact with each other; causing the other rotary member to rotate until the stopper portion of the other rotary member moves away from a rotation locus of the stopper portion of the one rotary member; and causing the one rotary member to rotate from the contacting position to the new product detecting position.

BRIEF DESCRIPTION OF THE DRAWINGS

To better understand the claimed invention, and to show how the same may be carried into effect, reference will now be made, by way of example only, to the accompanying drawings, in which:

DETAILED DESCRIPTION OF EXEMPLARY EMBODIMENTS

Figure 1:
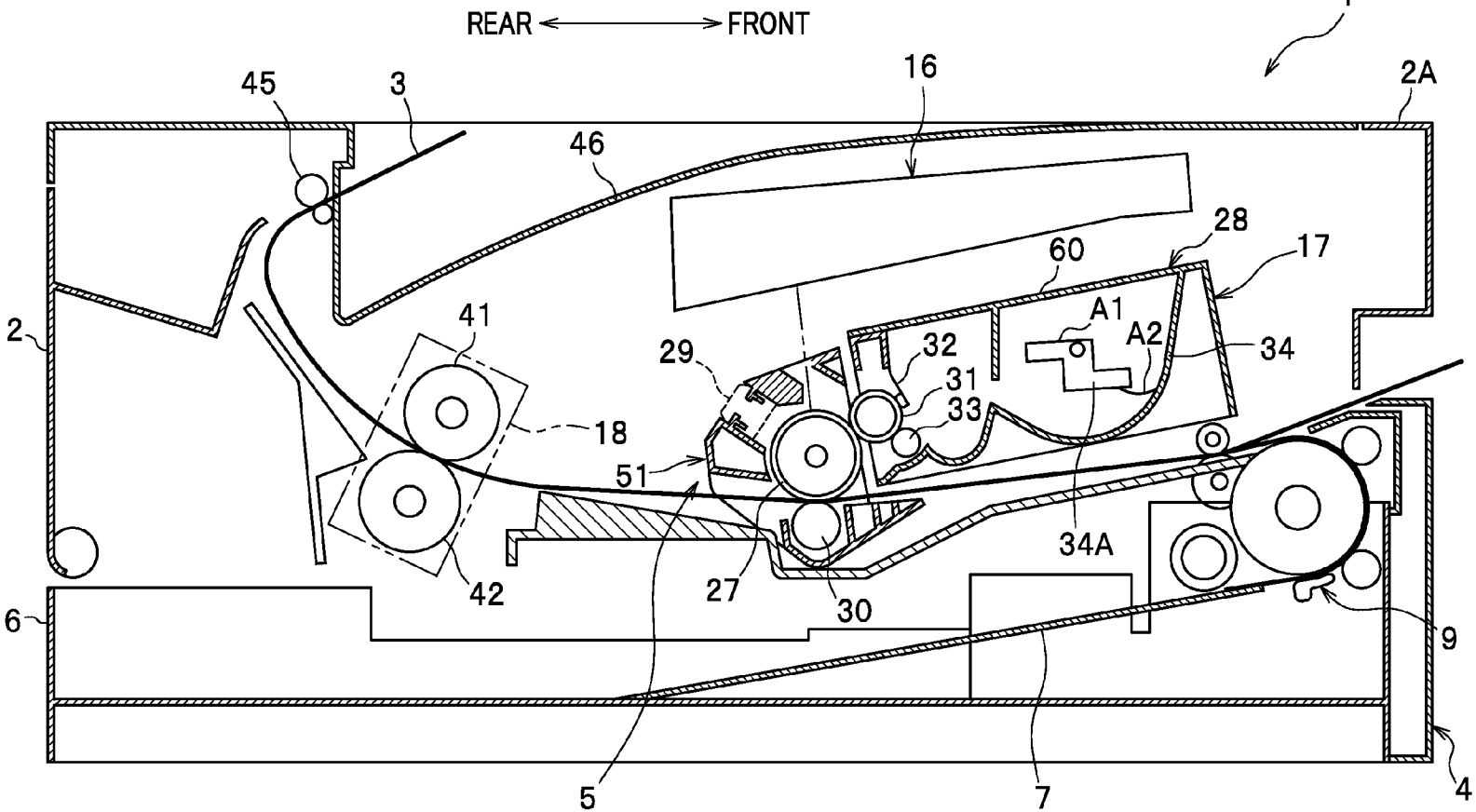
FIG. 1 is a side sectional view of a laser printer to which a developing cartridge according to one exemplary embodiment of the present invention is detachably mounted.

Detailed description will be given of an illustrative embodiment of the present invention with reference to the drawings. In the following description, a general arrangement of a laser printer (image forming apparatus) will be described briefly, and thereafter features of the present invention will be described in detail.

In the following description, unless otherwise stated, directions of the laser printer 1 refer to the directions as seen from a user facing to the laser printer 1 during its use. To be more specific, with reference to FIG. 1, the right-hand side of the drawing sheet corresponds to the "front" side of the laser printer, the left-hand side of the drawing sheet corresponds to the "rear" side of the printer, the front side of the drawing sheet corresponds to the "left" side of the printer, and the back side of the drawing sheet corresponds to the "right" side of the printer. Similarly, the direction extending from top to bottom of the drawing sheet corresponds to the "vertical" or "up/down (upper/lower or top/bottom) " direction of the laser printer.

As seen in FIG. 1, the laser printer 1 comprises a body casing 2, and several components housed within the body casing 2 which principally includes a feeder unit 4 for feeding a sheet 3 (e.g., of paper), and an image forming unit 5 for forming an image on the sheet 3.

The feeder unit 4 principally includes a sheet feed tray 6, a sheet pressure plate 7, and a sheet conveyance mechanism 9. In the feeder unit 4, sheets 3 stored in the sheet feed tray 6 are urged upward by the sheet pressure plate 7, separated one from the other, and conveyed by the sheet conveyance mechanism 9 into the image forming unit 5.

The image forming unit 5 principally includes a scanner unit 16, a process cartridge 17, and a fixing unit 18.

Although not shown in the drawings, the scanner unit 16 includes a laser emission device, a polygon mirror, a plurality of lenses, and a plurality of reflecting mirrors. In the scanner unit 16, a laser beam is caused to travel along a path indicated by a chain double-dashed line of FIG. 1, so that the outer peripheral surface of a photoconductor drum 27 is rapidly scanned and illuminated with the laser beam.

The process cartridge 17 is configured to be detachably attached to the body casing 2 through an opening formed when a front cover 2A provided at a front side of the body casing 2 is swung open. The process cartridge 17 principally includes a developing cartridge 28 as an example of a developer storage unit and a drum unit 51.

The developing cartridge 28 is designed to be assembled together with the drum unit 51, and the assembly of the developing cartridge 28 and the drum unit 51 is then detachably attached to the body casing 2. As an alternative, the developing cartridge 28 may be designed to be detachably attached to the drum unit 51 that is fixed to the body casing 2. The developing cartridge 28 principally includes a developing roller 31, a doctor blade 32 as an example of a layer thickness regulating member, a supply roller 33, a toner hopper 34, and an agitator 34A as an example of an agitating member. The doctor blade 32 slidably contacts the outer peripheral surface of the developing roller 31.

According to this developing cartridge 28, toner as an example of developer is agitated by the agitator 34A within the toner hopper 34, and supplied to the developing roller 31 through the supply roller 33, during which the toner is charged positively between the supply roller 33 and the developing roller 31. As the developing roller 31 rotates, the toner supplied onto the developing roller 31 is moved between the doctor blade 32 and the developing roller 31, frictionally charged therebetween, and carried on the developing roller 31 as a thin layer of toner having a predetermined thickness. Details of the developing cartridge 28 will be described later.

The drum unit 51 principally includes a photoconductor drum 27, a scorotron charger 29, and a transfer roller 30. In the drum unit 51, the outer peripheral surface of the photoconductor drum 27 is uniformly and positively charged by the scorotron charger 29, and then exposed to a rapidly sweeping laser beam from the scanner unit 16. Accordingly, the electric potential of the exposed area lowers, so that an electrostatic latent image based on image data is formed on the photoconductor drum 27.

Further, as the developing roller 31 rotates, the toner carried on the development roller 31 is supplied to the electrostatic latent image formed on the outer peripheral surface of the photoconductor drum 27. Accordingly, the electrostatic latent image is visualized and a toner image is formed on the outer peripheral surface of the photoconductor drum 27. Thereafter, while the sheet 3 is conveyed through between the photoconductor drum 27 and the transfer roller 30, the toner image carried on the outer peripheral surface of the photoconductor drum 27 is transferred onto the sheet 3.

The fixing unit 18 principally includes a heating roller 41 and a pressure roller 42. In the fixing unit 18, the toner image (i.e., toner) transferred onto the sheet 3 is thermally fixed on the sheet 3 while the sheet 3 passes through between the heating roller 41 and the pressure roller 42. After the sheet 3 passes through the fixing unit 18 and the toner image is thermally fixed on the sheet 3, the sheet 3 is ejected by a sheet eject roller 45 onto a sheet output tray 46.

<Detailed Structure of Developing Cartridge>

Detailed structure of the developing cartridge 28 which embodies features of the present invention will be described below.

Figure 2A:
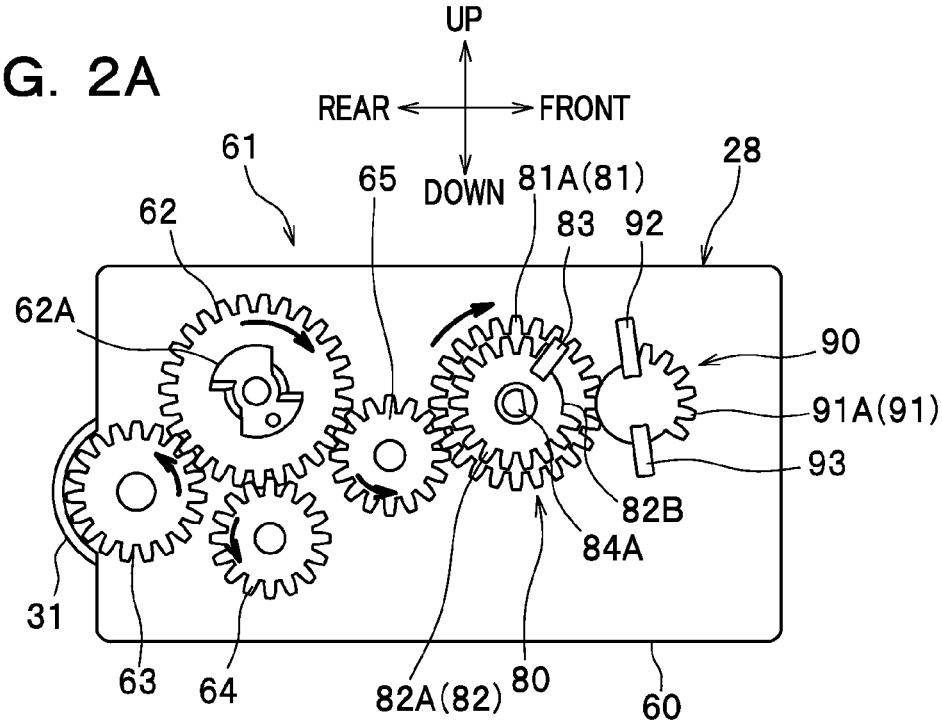
FIG. 2A is an explanatory view of the developing cartridge with a cover removed from a cartridge body.
Figure 2B:
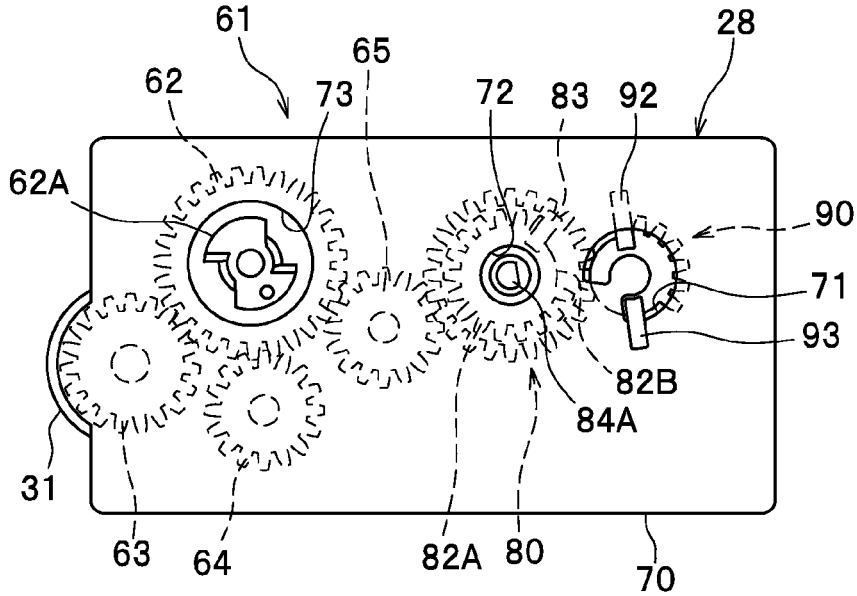
FIG. 2B is an explanatory view of the developing cartridge with the cover attached to the cartridge body.

As best seen in FIGS. 2A and 2B, other than the various components as described above such as the developing roller 31, the developing cartridge 28 includes a cartridge body 60 as an example of a casing, a gear mechanism 61 as an example of a force transmission mechanism, and a cover 70.

The gear mechanism 61 is a mechanism for transmitting a driving force that is input from an external device to the developing roller 31, the supply roller 33, and the agitator 34A. More specifically, the gear mechanism 61 includes an input gear 62 as an example of a driving force input member, a developing roller drive gear 63, a supply roller drive gear 64, an intermediate gear 65, an agitator drive gear 80 as an example of a first rotary member, and a reset gear 90 as an example of a second rotary member.

The input gear 62 is a gear configured to rotate when a driving force is transmitted from a drive unit 110 (see FIG. 4) provided in the body casing 2. The input gear 62 is rotatably supported in the cartridge body 60. A force transmission portion 62A is provided at a center part of the input gear 62. The force transmission portion 62A radially engages with a coupling portion (not shown) of the drive unit 110 so that the driving force from the drive unit 110 is input to the input gear 62. The developing roller drive gear 63 and the supply roller drive gear 64 are directly in mesh with the input gear 62, and the agitator drive gear 80 is indirectly in mesh with the input gear 62 through the intermediate gear 65.

The developing roller drive gear 63, the supply roller drive gear 64, and the agitator drive gear 80 are gears for driving the developing roller 31, the supply roller 33, and the agitator 34A, which are shown in FIG. 1, respectively. The developing roller drive gear 63, the supply roller drive gear 64, and the agitator drive gear 80 are integrally provided at one axial end of the developing roller 31, the supply roller 33, and the agitator 34A, respectively. These gears 63, 64, 80 receive the driving force directly or indirectly from the input gear 62 and rotate.

Figure 3A:
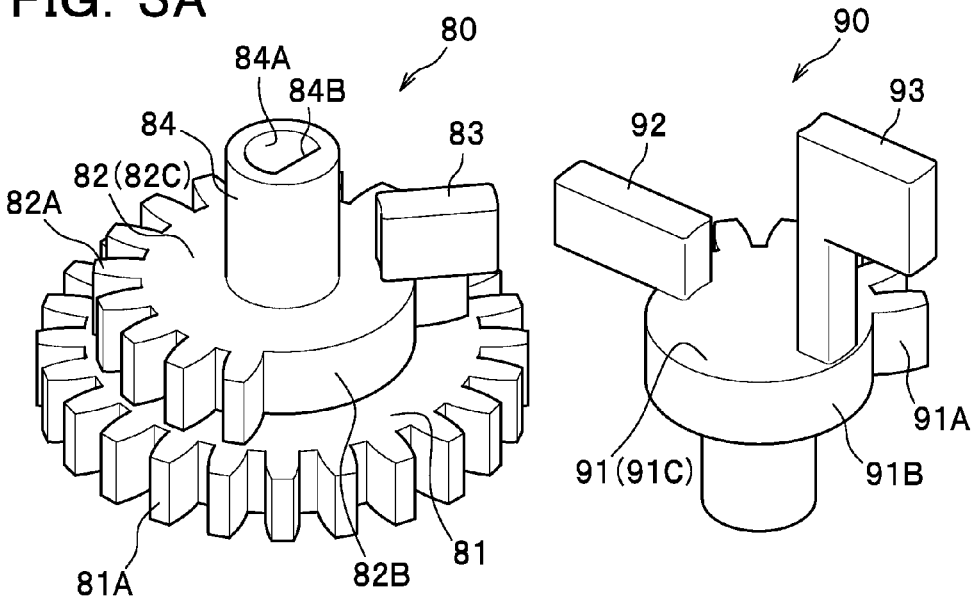
FIG. 3A is a perspective view showing an agitator drive gear and a reset gear.
Figure 3B:
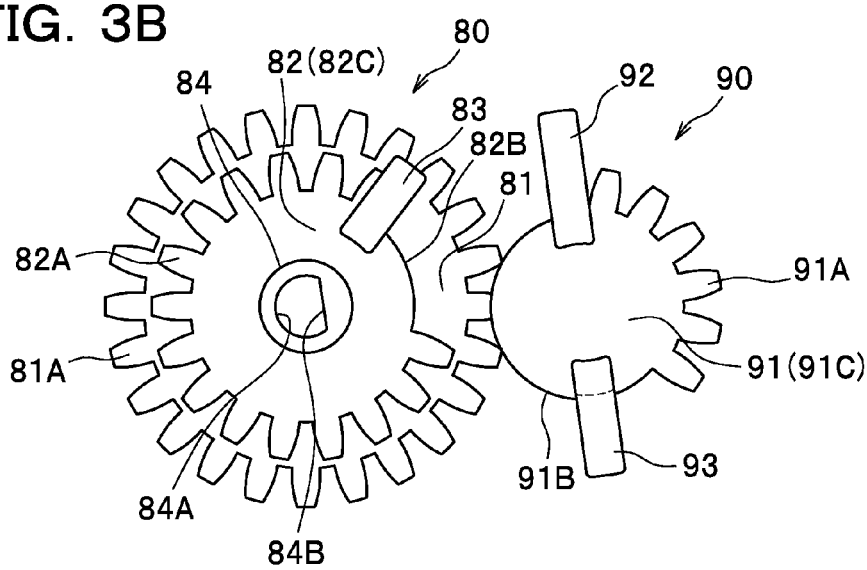
FIG. 3B is a side view showing the agitator drive gear and the reset gear.

As best seen in FIGS. 3A and 3B, the agitator drive gear 80 includes a large-diameter gear portion 81, a small-diameter gear portion 82, a first stopper portion 83, and a rotary shaft portion 84.

The large-diameter gear portion 81 is a gear having a diameter greater than that of the small-diameter gear portion 82. The large-diameter gear portion 81 has gear teeth 81A around the entire circumference thereof, and is always in mesh with the intermediate gear 65 (see FIG. 2).

The small-diameter gear portion 82 is a sector gear (i.e., partially toothless gear) having a first toothed section 82A as an example of a first contacting portion, and a first toothless section 82B as an example of a first non-contacting portion. The first toothed section 82A is provided along part of the outer periphery of the small-diameter gear portion 82, and at the remaining region of the small-diameter gear portion 82 the first toothless section 82B is formed. The small-diameter gear portion 82 is formed integrally and coaxially with the large-diameter gear portion 81. The first toothed section 82A is formed at a height suitable for meshing (contacting) with a second toothed section 91A of the reset gear 90, and while being meshed with the second toothed section 91A, transmits the driving force to the reset gear 90. The first toothless section 82B is arranged in the same axial position (i.e., height) as that of the first toothed section 82A but radially inward from the first toothed section 82A, so as not to contact with the reset gear 90 (i.e., second toothed section 91A).

The first stopper portion 83 is provided in a position offset from the first toothed section 82A (i.e., on the opposite side of the large-diameter gear portion 81 with respect to the small-diameter gear portion 82) in an axial direction of the agitator drive gear 80. More specifically, the first stopper portion 83 protrudes outward from an end surface 82C (an outside facing toward the cover 7) of the small-diameter gear portion 82. Further, the first stopper portion 83 is provided upstream of the first toothless section 82B as viewed in the rotational direction of the small-diameter gear portion 82 (i.e., at an upstream side in the rotational direction of the agitator drive gear 80, to which the driving force is input from the drive unit 110, as seen in FIG. 2), and protrudes radially outward beyond the first toothed section 82A.

Figure 7A:
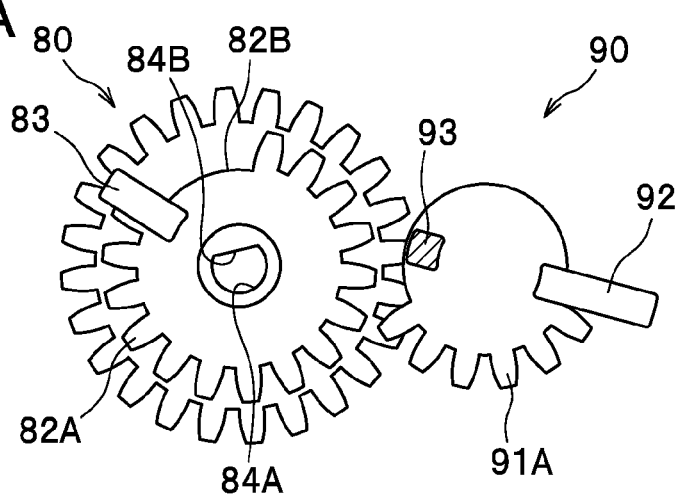
FIGS. 7A and 7B are explanatory views each showing a state in which a first non-contacting portion of the agitator drive gear does not face the reset gear.
Figure 7B:
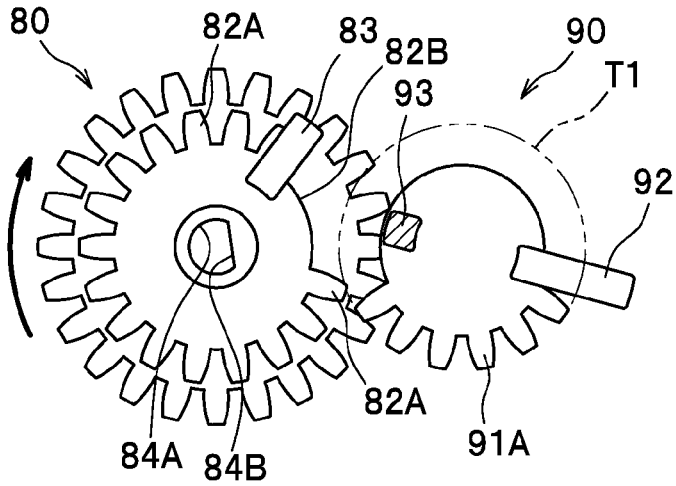
Figure 7C:
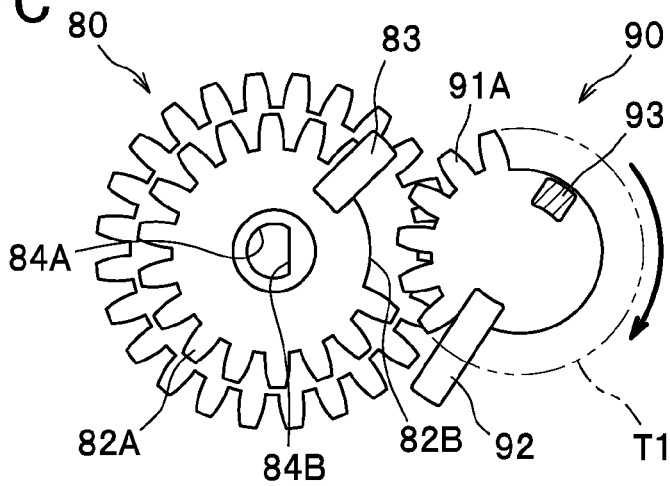
FIG. 7C is an explanatory view showing a state in which the first non-contacting portion of the agitator drive gear faces the reset gear.

In other words, as seen in FIG. 7C, the first stopper portion 83 is disposed and sized to be radially engageable with a second stopper portion 92 of the reset gear 90 to be described later, when the first toothless section 82B faces the reset gear 90 and the second toothed section 91A of the reset gear 90 is not in contact with the agitator drive gear 80.

The rotary shaft portion 84 protrudes axially from center parts of both end surfaces of the agitator drive gear 80, and is rotatably supported by the cartridge body 60 and the cover 70. A D-shaped hole 84A is formed in an outer end surface of the rotary shaft portion 84.

The D-shaped hole 84A includes a straight section 84B that is disposed (oriented) in a direction substantially corresponding to the circular arc defined by the first toothless section 82B. Therefore, as seen in FIG. 7C, when the straight section 84B is oriented to face the center of the reset gear 90, the first toothless section 82B faces the reset gear 90 so that the second toothed section 91A of the reset gear 90 does not interfere with the agitator drive gear 80.

As best seen in FIG. 1, the agitator 34A includes a support frame A1 rotatably supported in the cartridge body 60, and a flexible sheet A2 supported by the support frame A1. A distal end portion of the sheet A2 is deflected to point in the anticlockwise direction, and when the sheet A2 rotates in the clockwise direction to agitate toner, the distal end portion slides along an inner peripheral surface of the toner hopper 34.

For this reason, the agitator drive gear 80 is readily rotatable in the clockwise direction (i.e., in a direction of rotation made by the driving force transmitted from the drive unit 110; direction shown by the arrow in FIG. 2), but is hard to rotate in the anticlockwise direction because the distal end portion of the sheet A2 is lodged on the inner peripheral surface of the toner hopper 34 and gives a resistance.

As best seen in FIG. 3, the reset gear 90 is provided adjacent to the agitator drive gear 80, and driven to rotate by receiving the driving force from the agitator drive gear 80. The reset gear 90 is rotatably supported in the cartridge body 60. The reset gear 90 includes a sector gear (i.e., partially toothless gear) 91, a second stopper portion 92, and a detected portion 93. For the purpose of explanation, the agitator drive gear 80 and the reset gear 90 are separately illustrated in FIG. 3.

The sector gear 91 has a second toothed section 91A as an example of a second contacting portion, and a second toothless section 91B as an example of a second non-contacting portion. The second toothed section 91A is provided along part of the outer periphery of the sector gear 91, and at the remaining region of the sector gear 91 the second toothless section 91B is formed. The second toothed section 91A is formed at a height suitable for meshing (contacting) with the first toothed section 82A of the agitator drive gear 80, and while being meshed with the first toothed section 82A, the driving force is transmitted from the agitator drive gear 80. The second toothless section 91B is arranged in the same axial position (i.e., height) as that of the second toothed section 91A but radially inward from the second toothed section 91A, so as not to contact with the agitator drive gear 80 (i.e., first toothed section 82A).

Figure 6A:
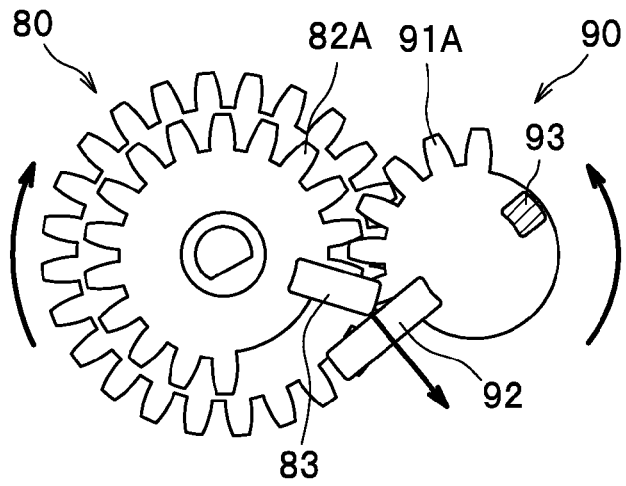
FIG. 6A is an explanatory view showing a state in which a first stopper portion contacts with and pushes a second stopper portion, so that the reset gear starts to rotate.

The second stopper portion 92 is provided in a position offset from the second toothed section 91A in an axial direction of the reset gear 90. More specifically, the second stopper portion 92 protrudes outward from an outside end surface 91C of the sector gear 91. Further, the second stopper portion 92 is provided upstream of the second toothless section 91B as viewed in the rotational direction of the sector gear 91 (i.e., at an upstream side in the rotational direction of the reset gear 90, to which the driving force is input from the drive unit 110, as seen in FIG. 6A), and protrudes radially outward beyond the second toothed section 91A.

In other words, the second stopper portion 92 is disposed and sized to be radially engageable with the first stopper portion 83, when the first toothless section 82B faces the reset gear 90 and the second toothed section 91A of the reset gear 90 is not in contact with the agitator drive gear 80. In other words, as best seen in FIG. 7C, when the first toothed section 82A of the agitator drive gear 80 is completely moved away from and positioned outside the rotation locus T1 of the second toothed section 91A of the reset gear 90, the second stopper portion 92 can be brought into contact with the first stopper portion 83.

Figure 5A:
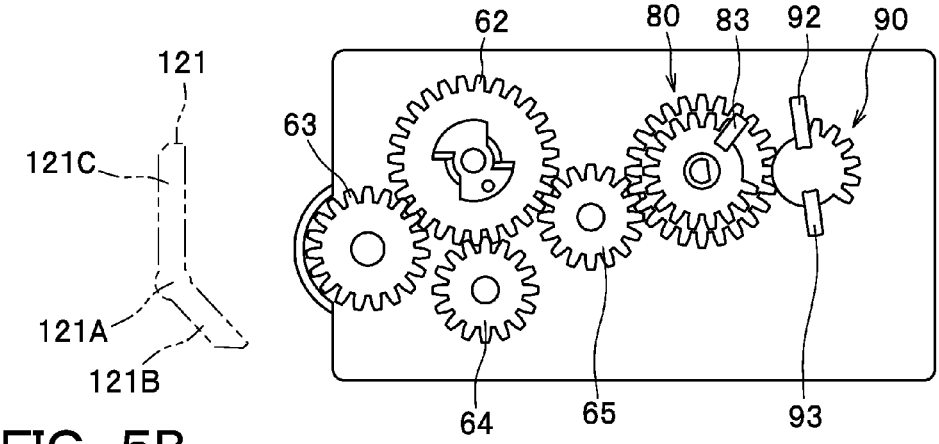
FIG. 5A is an explanatory view showing a state in which a detected portion is not in contact with a detection arm.
Figure 6B:
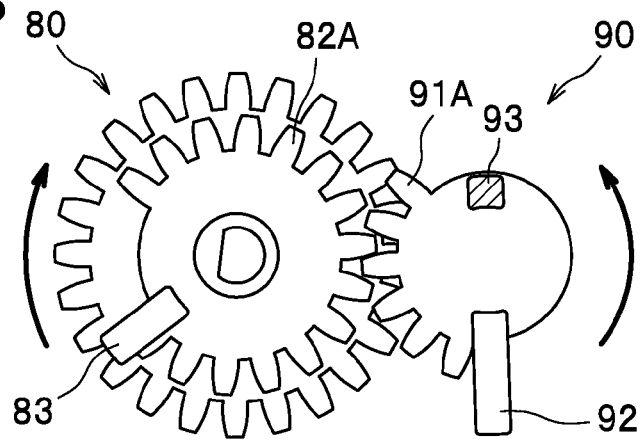
FIG. 6B is an explanatory view showing a state in which gear teeth of the agitator drive gear and gear teeth of the reset gear are meshed with each other and both gears rotate together.
Figure 6C:
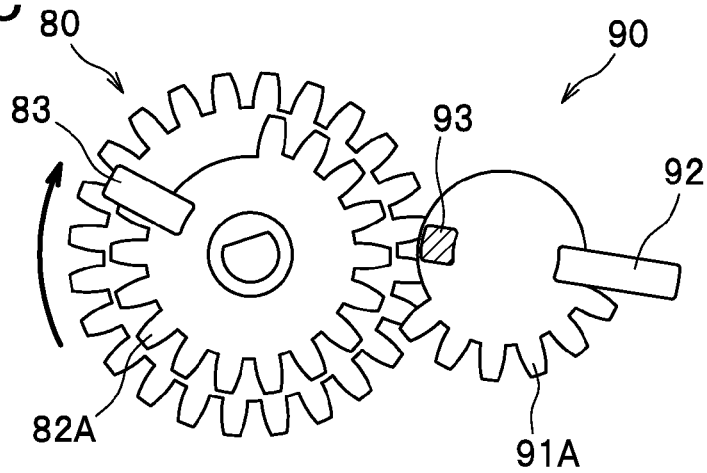
FIG. 6C is an explanatory view showing a state in which the agitator drive gear is disengaged from the reset gear.

The detected portion 93 extends from a position offset from the center of rotation of the reset gear 90 toward an outside of the cover 70. The detected portion 93 is detected by a new product detecting unit 120 (see FIG. 4) as an example of a detector provided in the body casing 2. To be more specific, the detected portion 93 is configured to be movable between a new product detecting position and a used product detecting position, and the detected portion 93 is positioned in the new product detecting position as shown in FIG. 5A before use of the developing cartridge 28 and in the used product detecting position as shown in FIG. 6C after use of the developing cartridge 28.

The rotation of the reset gear 90 is restricted to less than 360 degrees by means of a restriction means such as a clearance slot 71 to be described later. More specifically, because of the restriction means, the reset gear 90 is not rotatable in the clockwise direction from the new product detecting position shown in FIG. 5A, and similarly is not rotatable in the anticlockwise direction from the used product detecting position shown in FIG. 6C.

As seen in FIG. 2B, the cover 70 is a substantially rectangular tube-shaped case having a bottom, and is attached to the cartridge body 60 to cover the gear mechanism 61. A C-shaped clearance slot 71 is formed at a front upper part of the cover 70 so that the detected portion 93 extends beyond the outside of the cover 70 through the clearance slot 71 and the movement of the detected portion 93 from the new product detecting position to the used product detecting position is allowed through the clearance slot 71.

An opening 72 is formed in the cover 70 rearwardly of the clearance slot 71 such that the orientation of the agitator drive gear 80 (i.e., orientation of the D-shaped hole 84A) can be seen through the opening 72. To be more specific, the opening 72 is opposite to the D-shaped hole 84A of the agitator drive gear 80 in the axial direction of the agitator drive gear 80 so that the D-shaped hole 84A is exposed to outside through the opening 72.

An opening 73 is also formed at a rear upper part of the cover 70 so that the force transmission portion 62A of the input gear 62 is exposed to outside through the opening 73.

<Detailed Structure of Body Casing>

Figure 4:
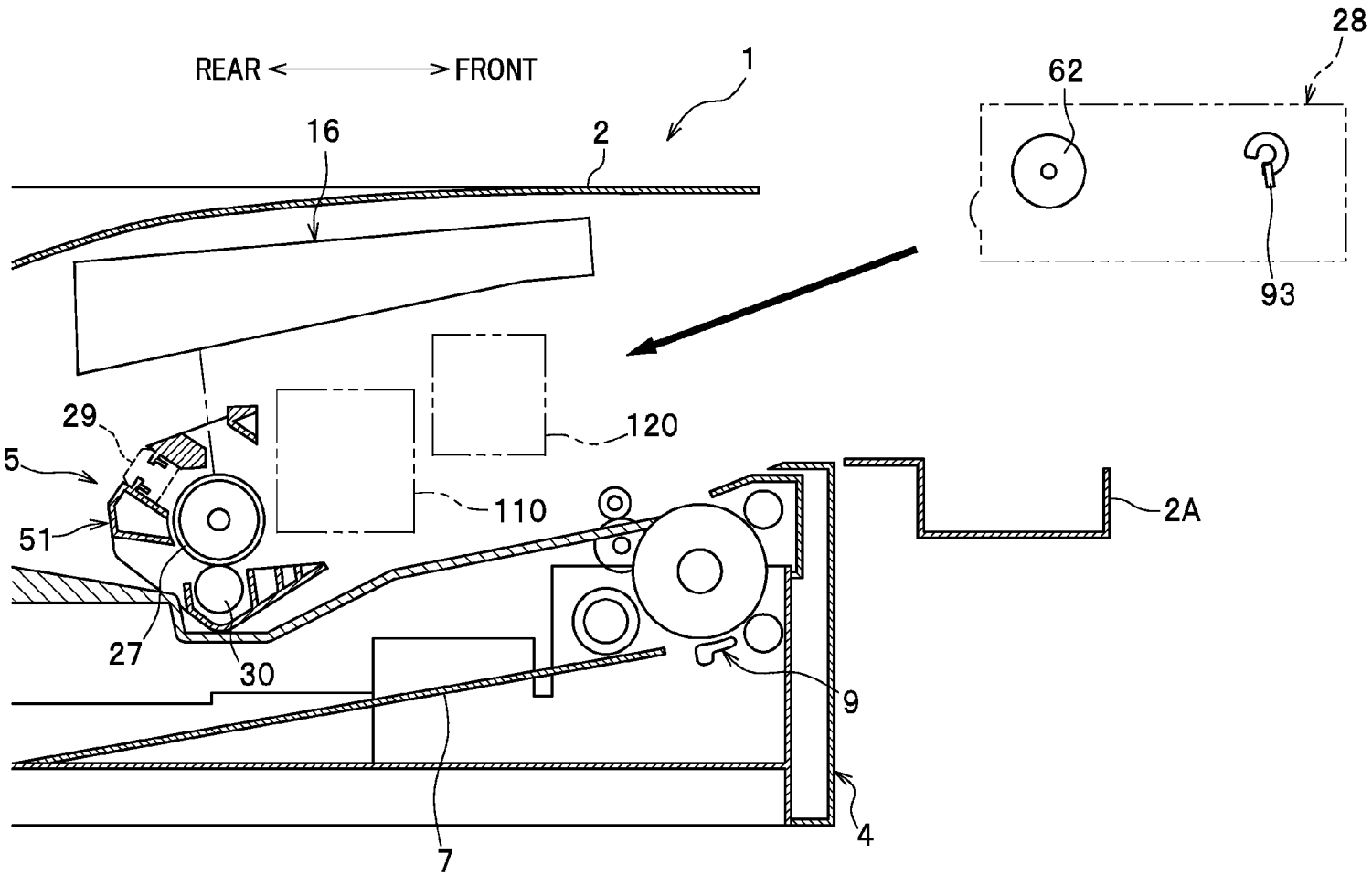
FIG. 4 is an explanatory view illustrating a state in which the developing cartridge is attached to a main body casing of the laser printer.

As best seen in FIG. 4, the drive unit 110 and the new product detecting unit 120 are disposed in the body casing 2. Brief description will be given of the drive unit 110 and the new product detecting unit 120.

Provided in the body casing 2 at positions contacting the attached developing cartridge 28 are the drive unit 110 configured to transmit the driving force to the input gear 62 of the developing cartridge 28 and the new product detecting unit 120 for carrying out a detection to determine whether or not the attached developing cartridge 28 is a new product.

Although not shown in the drawings, the drive unit 110 includes a drive motor, a plurality of gears, and a coupling portion. When the developing cartridge 28 is inserted into and attached to the body casing 2, the coupling portion of the drive unit 110 is coupled with the input gear 62, so that the driving force from the drive motor can be transmitted to the input gear 62 through the gears and the coupling portion. The coupling portion is configured to move toward and away from the input gear 62, for example, synchronously with closing and opening the front cover 2A.

As best seen in FIG. 5, the new product detecting unit 120 includes a detection arm 121, an optical sensor (not shown), and a controller (not shown). The detection arm 121 includes a rotation shaft portion 121A rotatably supported in the body casing 2, and a light shielding arm 121B and an abutment arm 121C each extending radially outward from the rotation shaft portion 121A. The detection arm 121 is swingable around the rotation shaft portion 121A.

A coil spring (not shown) is attached to the detection arm 121 at an appropriate position, so that the detection arm 121 is always urged in a neutral position (i.e., position shown in FIG. 5A) by the coil spring. At this neutral position, the light shielding arm 121B is positioned between a light emitting portion (not shown) and a light receiving portion (not shown) of the optical sensor. Further, at this neutral position, the abutment arm 121C is engageable with the detected portion 93 if the detected portion 93 is positioned in the new product detecting position, and is not engageable with the detected portion 93 if the detected portion 93 is positioned in the used product detecting position (or the abutment arm 121C is located in such a position that can return to the neutral position after attachment of the developing cartridge 28 even if the abutment arm 121 contacts with the detected portion 93 and is moved from the neutral position).

Figure 5B:
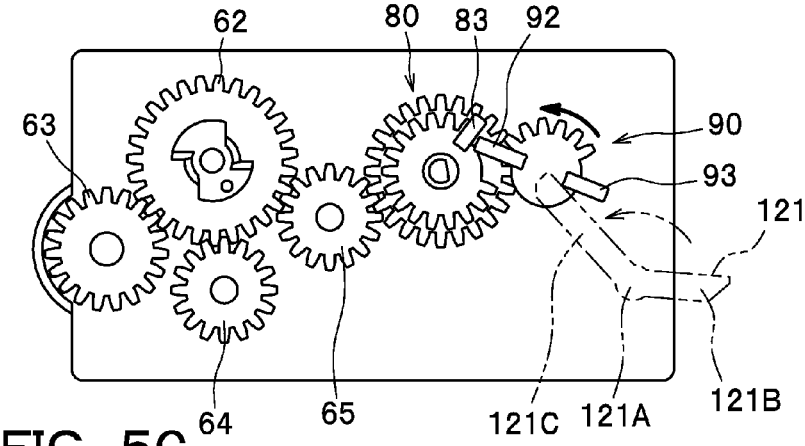
FIG. 5B is an explanatory view showing a state in which the detected portion is in contact with the detection arm.

In this new product detecting unit 120, as explained in FIGS. 5A and 5B in this order, when the developing cartridge 28 is inserted into and attached to the body casing 2, the detected portion 93 positioned in the new product detecting position pushes the abutment arm 121C backward to cause the detection arm 121 to swing. By this swinging motion of the detection arm 121, the light shielding arm 121B moves out of the position between the light emitting portion and the light receiving portion, so that the light sensor is switched ON.

When the detection arm 121 swings in this way, the detected portion 93 is relatively pushed forward by the detection arm 121 and moves into a position shown in FIG. 5B. By this movement of the detected portion 93, the second stopper portion 92 moves backward and enters the rotation locus of the first stopper portion 83.

Figure 5C:
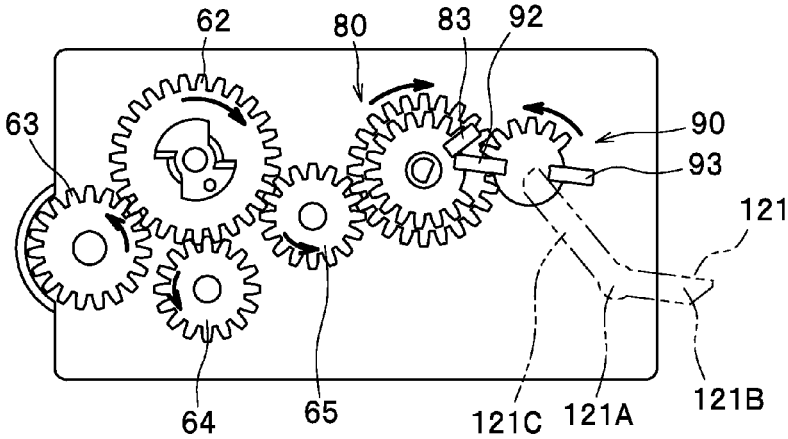
FIG. 5C is an explanatory view showing a state in which a driving force is transmitted to an input gear.

Thereafter, as seen in FIG. 5C, when the driving force is transmitted from the drive unit 110 to the input gear 62, the gears 63-65, 80 rotate to thereby cause the first stopper portion 83 of the agitator drive gear 80 to rotate. The first stopper portion 83 then comes into contact with the second stopper portion 92 of the reset gear 90 and pushes the second stopper portion 92, so that the reset gear 90 starts to rotate. Accordingly, as seen in FIG. 6A, the second toothed section 91A of the reset gear 90 and the first toothed section 82A of the agitator drive gear 80 are meshed with each other. As seen in FIG. 6B, during the meshing engagement between the first toothed section 82A and the second toothed section 91A, the reset gear 90 rotates together with the agitator drive gear 80.

As best seen in FIG. 6C, when the first toothed section 82A of the agitator drive gear 80 is disengaged from the second toothed section 91A of the reset gear 90, the rotation of the reset gear 90 stops and the detected portion 93 is positioned in the used product detecting position.

During the movement of the detected portion 93 from the new product detecting position to the used product detecting position, the detected portion 93 is disengaged from the detection arm 121 and the detection arm 121 returns to the neutral position by the restoring force of the coil spring, so that the light sensor is switched OFF. The controller then determines that the attached developing cartridge 28 is a new product, for example, based on this change of the light sensor from ON to OFF.

<Method for Manufacturing Recycling Product>

Description will be given of the method for manufacturing a recycling product; namely, a used and empty developing cartridge 28 (without toner) is collected and refilled with toner for recycling the used developing cartridge 28.

An operator first checks the collected used developing cartridge 28 to see the orientation of the D-shaped hole 84A through the opening 72 formed in the cover 70 (see FIG. 2B). As seen in FIGS. 7A and 7B, if the orientation of the D-shaped hole 84A (i.e., the orientation of the straight section 84B) does not face the center of the reset gear 90 (i.e., does not coincide with the direction parallel to a side edge of the cover 70), the operator rotates the force transmission portion 62A of the input gear 62 in the clockwise direction (first rotation direction) until the straight section 84B of the D-shaped hole 84A (straight section of the shaft) faces to the center of the reset gear 90 (namely, the straight section 84B is positioned along the vertical direction as shown in FIG. 7C).

Accordingly, the first toothless section 82B faces the reset gear 90, and the first toothed section 82A of the agitator drive gear 80 is completely moved away from and positioned outside the rotation locus T1 of the second toothed section 91A. The operator can smoothly rotate the force transmission portion 62A in the clockwise direction because the agitator 34A does not give a resistance. Further, as compared with the case in which the operator rotates the agitator drive gear 80 that is speed reduced relative to the input gear 62, the operator can smoothly rotate the force transmission portion 62A because the rotation torque thereof is smaller.

It is to be noted that adjusting the orientation of the D-shaped hole 84A while visually checking the straight section 84B through the opening 72 may be insufficient, and as seen in FIG. 7B, the straight section 84B may be inclined slightly with respect to the vertical direction of this figure, with the result that the first toothed section 82A of the agitator drive gear 80 (i.e., gears adjacent to the first toothless section 82B at a downstream side in the rotational direction of the agitator drive gear 80) may be partly positioned in the rotation locus T1 of the second toothed section 91A. For this reason, it is preferable that while rotating the force transmission portion 62A, the operator holds the detected portion 93 and rotates the reset gear 90 in the clockwise direction of the figure, during which the operator checks whether no interference occurs between the second toothed section 91A of the reset gear 90 and the first toothed section 82A.

Figure 8A:
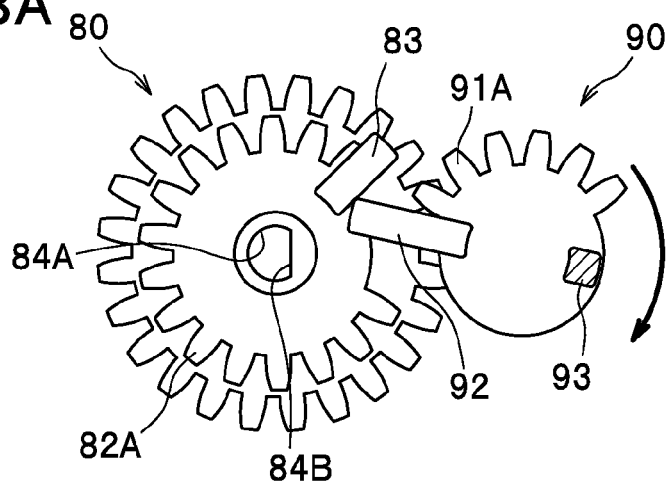
FIG. 8A is an explanatory view showing a state in which the second stopper portion comes into contact with the first stopper portion by the rotation of the reset gear.

After adjusting the orientation of the agitator drive gear 80 into the orientation shown in FIG. 7C, the operator holds the detected portion 93 that is positioned in the used product detecting position and rotates the reset gear 90 in the clockwise direction of the figure. As best seen in FIG. 8A, before the detected portion 93 reaches the new product detecting position, the second stopper portion 92 of the reset gear 90 is brought into contact with the first stopper portion 83 of the agitator drive gear 80. Namely, the operator rotates the reset gear 90 from the used product detecting position to a contacting position at which the first stopper portion 83 of the agitator drive gear 80 and the second stopper portion 92 of the reset gear 90 are in contact with each other.

Figure 8B:
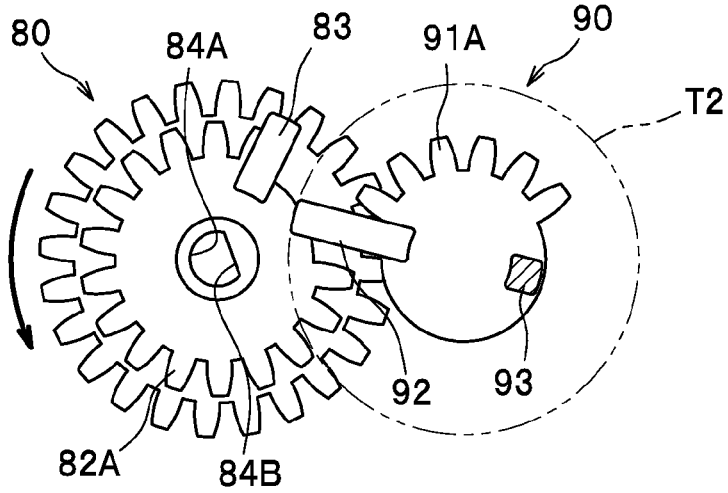
FIG. 8B is an explanatory view showing a state in which the first stopper portion is moved away from the rotation locus of the second stopper portion.
Figure 8C:
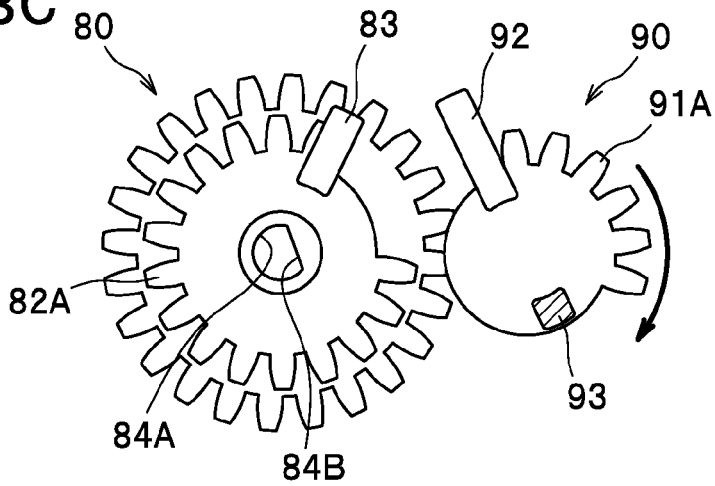
FIG. 8C is an explanatory view showing a state in which the detected portion is reset to a new product detecting position.

Thereafter, as best seen in FIG. 8B, the operator manipulates the force transmission portion 62A of the input gear 62 to slightly rotate the agitator drive gear 80 in the anticlockwise direction (second rotation direction) until the first stopper portion 83 is moved away from and positioned outside the rotation locus T2 of the second stopper portion 92 of the reset gear 90. In this position, even if the operator rotates the second stopper portion 92 further in the clockwise direction, the second stopper portion 92 does not interfere with the first stopper portion 83. Therefore, as best seen in FIGS. 8B and 8C, the operator can rotate the reset gear 90 from the contacting position to the new product detecting position.

When the operator rotates the force transmission portion 62A in the anticlockwise direction from the position shown in FIG. 8A to the position shown in FIG. 8B, the agitator 34A provides a resistance. However, the operator can easily rotate the force transmission portion 62A because a large force is not required for moving the force transmission portion 62A to such a small distance.

As described above, the operator can reset the detected portion 93 from the used product detecting position to the new product detecting position without removing the cover 70. The developing cartridge 28 may be refilled with toner either before or after resetting the detected portion 93 to the new product detecting position.

<Prevention Against User's Unintentional Operation>

Detailed description will be given of an interaction of the gears 80, 90 when the user unintentionally operates the detected portion 93 and moves the same from the used product detecting position to the new product detecting position.

As best seen in FIGS. 7A and 7B, the user may unintentionally move the detected portion 93 from the used product detecting portion toward the new product detecting portion, while the first toothed section 82A of the agitator drive gear 80 is positioned in the rotation locus T1 of the second toothed section 91A (i.e., the first toothless section 82B does not face the reset gear 90). However, the movement of the detected portion 93 is stopped before reaching the new product detecting position because the second toothed section 91A interferes with the first toothed section 82A.

As best seen in FIG. 7C, the user may unintentionally move the detected portion 93 from the used product detecting portion toward the new product detecting portion, while the first toothed section 82A of the agitator drive gear 80 is completely moved away from and positioned outside the rotation locus T1 of the second toothed section 91A (i.e., the first toothless section 82B faces the reset gear 90). However, the movement of the detected portion 93 is stopped before reaching the new product detecting position because the second stopper portion 92 is brought into contact with the first stopper portion 83 as shown in FIG. 8A and a further rotation of the detected portion 93 is prevented.

Further, the agitator drive gear 80 and the reset gear 90 may be rotated into the position shown in FIG. 8A because of the user's unintentional operation. However, when the developing cartridge 28 is attached to the body casing 2, the detected portion 93 is moved into the used product detecting position shown in FIG. 6C by the driving force from the drive unit 110 through the positions shown in FIGS. 6A and 6B.

According to the embodiment as described above, the following advantageous effects can be achieved.

If the user unintentionally moves the detected portion 93 from the used product detection position toward the new product detecting position, it is possible to prevent the detected portion 93 from being reset to the new product detecting position because of the interference between the two toothed sections 82A, 91A or the interference between the two stopper portions 83, 92. To be more specific, in order to rotate the reset gear having the detected portion 93, it is necessary to rotate the gear mechanism 61 together with the reset gear 90, which results in a large resistance during the rotation of the reset gear 90. This can prevent the user from unintentionally resetting the detected portion 93 to the new product detecting position. Especially, with the configuration of this embodiment in which the driving force is transmitted from the gear mechanism 61 to the developing roller 31, a large torque is required to rotate the developing roller 31 that is in contact with the doctor blade 32, and a small force generated by the user's unintentional operation could not possibly cause the first stopper portion 83 to move. This can reliably prevent the user from unintentionally resetting the detected portion 93 to the new product detecting position.

During the recycling process of the developing cartridge 28, the operator can reset the detected portion 93 from the used product detecting position to the new product detecting position without removing the cover 70. It is therefore possible to improve the workability for recycling the developing cartridge 28.

Since the cover has the opening 72 through which the orientation of the agitator drive gear 80 (i.e., the orientation of the D-shaped hole 84A) is seen, the operator can easily move and position the substantially whole first toothed section 82A outside the rotation locus T1 of the second toothed section 91A so that the first toothless section 82B is positioned to face the reset gear 90 during the recycling process.

Since the first and second stopper portions 83, 92 protrude radially outward beyond the first and second toothed sections 82A, 91A, respectively, one of these stopper portions 83, 92 does not become too long with respect to the other stopper portions 92, 83. It is therefore possible to prevent interference of one extremely long stopper portion with other components.

Although the present invention has been described in detail with reference to the above exemplary embodiment, the present invention is not limited to this specific embodiment and various changes and modifications may be made without departing from the scope of the present invention as claimed in the appended claims.

In the above embodiment, the first and second contacting portions correspond to the toothed sections 82A, 91A. However, the present invention is not limited to this specific embodiment. For example, the first rotary member and the second rotary member may be friction gears, which contact with each other at their substantially cylindrical surfaces as contacting portions. However, the toothed sections 82A, 91A (i.e., gear teeth) according the above exemplary embodiment can transmit the driving force more reliably than the friction gears. This is because the meshing gear teeth can transmit the driving force more reliably than the frictionally contacting cylindrical surfaces of the friction gears.

In the above embodiment, the agitator drive gear 80 corresponds to the first rotary member. However, the present invention is not limited to this specific embodiment, and the first rotary member may be another gear.

In the above embodiment, the developing cartridge 28 corresponds to the developer storage unit. However, the present invention is not limited to this specific embodiment. For example, the developer storage unit may be a toner cartridge without a developing roller, or a process cartridge including a photoconductor drum, a developing roller, a developer storage chamber, etc.

In the above embodiment, the agitator 34A including the support frame A1 and the flexible sheet A2 corresponds to the agitating member. However, the present invention is not limited to this specific embodiment. For example, only the frame may form the agitating member. As an alternative, the sheet and a rotation shaft may form the agitating member.

In the above embodiment, the new product detecting unit 120 including the detection arm 121 engageable with the detected portion 93 corresponds to the detector. However, the present invention is not limited to this specific embodiment. For example, the detector may be an optical sensor, which can detect whether or not the detected portion is positioned in the new product detecting position by directly illuminating the detected portion with light.

In the above embodiment, the cover 70 has the opening 72 through which the D-shaped hole 84A is exposed to view. However, according to the present invention, the opening may be formed at any position as long as the orientation of the first rotary member can be seen from outside. For example, an opening may be formed in the cover so that the contacting position between the first rotary member and the second rotary member (i.e., the position at which two rotary loci of the first and second contacting portions contact) can be seen from outside through the opening. According to this configuration too, the orientation of the first rotary member can be adjusted while checking the first non-contacting portion of the first rotary member through the opening.

Further, the cover may not have the opening for checking the orientation of the first rotary member from outside. Even in this configuration, the worker can adjust the orientation of the first non-contacting portion in a groping manner so as to face the second rotary member (i.e., to cause the first contacting portion to be completely moved away from and positioned outside the rotation locus of the second contacting portion) by rotating the first rotary member and the second rotary member.

In the above exemplary embodiment, the present invention has been applied to the laser printer 1. However, the present invention is not limited to this specific embodiment, and is applicable to other image forming apparatuses such as a copying machine and a complex machine.

Further, in the above exemplary embodiment, the sheet 3 such as a cardboard, a postcard, and a thin paper, etc. is used as an example of a recording sheet. However, the present invention is not limited to this specific embodiment. For example, an OHP sheet may be used as the recording sheet.

What is claimed is:

1. A developer storage unit designed to be detachably attached to an image forming apparatus, the developer storage unit comprising:

a casing for storing developer;

an agitating member configured to agitate developer within the casing;

a force transmission mechanism configured to transmit a driving force from the image forming apparatus at least to the agitating member; and a cover attached to the casing for covering the force transmission mechanism, wherein the force transmission mechanism comprises:

a driving force input member configured to rotate when the driving force is transmitted from the image forming apparatus:

a first rotary member configured to rotate by receiving the driving force from the driving force input member; and a second rotary member configured to rotate by receiving the driving force from the first rotary member, wherein the first rotary member includes:

a first contacting portion capable of contacting with the second rotary member to transmit the driving force to the second rotary member;

a first non-contacting portion arranged in the same axial position as that of the first contacting portion but radially inward from the first contacting portion, so as not to contact with the second rotary member; and a first stopper portion provided in a position offset from the first contacting portion in an axial direction of the first rotary member, wherein the second rotary member includes:

a second contacting portion capable of contacting with the first rotary member to receive the driving force from the first rotary member;

a second non-contacting portion arranged in the same axial position as that of the second contacting portion but radially inward from the second contacting portion, so as not to contact with the first rotary member;

a second stopper portion provided in a position offset from the second contacting portion in an axial direction of the second rotary member; and a detected portion extending from a position offset from a center of rotation of the second rotary member toward an outside of the cover, the detected portion being detected by a detector provided in the image forming apparatus, wherein the detected portion is configured to be movable between a new product detecting position and a used product detecting position that is different from the new product detecting position, and the detected portion is positioned in the new product detecting position before use of the developer storage unit and in the used product detecting position after use of the developer storage unit, and wherein when the second rotary member is caused to be rotated in a direction where the detected portion moves from the used product detecting position to the new product detecting position while the first non-contacting portion of the first rotary member is positioned to face the second rotary member, the second stopper portion comes into contact with the first stopper portion before the detected portion reaches the new product detecting position.

2. The developer storage unit according to claim 1, wherein the cover has an opening, through which an orientation of the first rotary member is seen.

3. The developer storage unit according to claim 1, wherein the first and second stopper portions protrude radially outward beyond the first and second contacting portions, respectively.

4. The developer storage unit according to claim 1, wherein the first and second contacting portions comprise gear teeth.

5. The developer storage unit according to claim 1 further comprising:

a developing roller configured to carry developer stored in the casing; and a layer thickness regulating member in contact with the developing roller to regulate a layer thickness of the developer on the developing roller, wherein the developing roller rotates when the driving force is input from the driving force input member.

6. The developer storage unit according to claim 2, wherein a D-shaped hole is formed in a rotary shaft portion of the first rotary member, and the D-shaped hole is positioned opposite to the opening of the cover in an axial direction of the rotary shaft portion.

7. The developer storage unit according to claim 6, wherein a straight section of the D-shaped hole is arranged in a position corresponding to the first non-contacting portion.

8. The developer storage unit according to claim 1, wherein the first stopper portion protrudes radially outward from a region of the first non-contacting portion, and the second stopper portion protrudes radially outward from a region of the second non-contacting portion.

9. A method for manufacturing a recycling product by recycling a developer storage unit, which comprises two adjacent rotary members each comprising:

a contacting portion capable of contacting with another adjacent rotary member to transmit a driving force between the adjacent rotary members;

a non-contacting portion arranged radially inward from the contacting portion so as not to contact with the adjacent rotary member;

a stopper portion provided in a position offset from the contacting portion in an axial direction of the rotary member; and a detected portion provided on one rotary member of the two adjacent rotary members and configured to be detected by a detector provided in an image forming apparatus, wherein the method comprises the following steps for resetting the detected portion from a used product detecting position to a new product detecting position:

bringing the non-contacting portion of the other rotary member into a position facing to the one rotary member;

causing the one rotary member to rotate from the used product detecting position to a contacting position at which the stopper portion of the one rotary member and the stopper portion of the other rotary member are in contact with each other;

causing the other rotary member to rotate until the stopper portion of the other rotary member moves away from a rotation locus of the stopper portion of the one rotary member; and causing the one rotary member to rotate from the contacting position to the new product detecting position.

10. The method according to claim 9, wherein the developer storage unit has a cover for covering the two adjacent rotary members, and wherein the step of bringing the non-contacting portion of the other rotary member into a position facing to the one rotary member is performed while checking an orientation of the other rotary member through a hole formed in the cover.

11. The method according to claim 10, wherein a D-shaped hole is formed in a rotary shaft portion of the other rotary member in a position facing the opening, and wherein the step of bringing the non-contacting portion of the other rotary member into a position facing to the one rotary member is performed while checking an orientation of the D-shaped hole through the opening.

12. The method according to claim 9, wherein the developer storage unit includes a driving force input member configured to transmit a driving force to the two adjacent rotary members, and wherein the non-contacting portion of the other rotary member is brought into a position facing to the one rotary member by rotating the driving force input member.

13. The method according to claim 12, wherein the other rotary member is configured to be speed reduced relative to the driving force input member.

* * * * *